US007547231B1

(12) United States Patent
Domitrovits et al.

(10) Patent No.: US 7,547,231 B1
(45) Date of Patent: Jun. 16, 2009

(54) LARGE ARRAY CONNECTOR FOR COUPLING WAFERS WITH A PRINTED CIRCUIT BOARD

(75) Inventors: Michael J. Domitrovits, New Paltz, NY (US); Emanuele F. Lopergolo, Marlboro, NY (US); Prabjit Singh, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/036,878

(22) Filed: Feb. 25, 2008

(51) Int. Cl.
*H01R 13/648* (2006.01)

(52) U.S. Cl. ..... 439/608

(58) Field of Classification Search ..... 439/65, 439/79, 608, 108
See application file for complete search history.

(56) References Cited

U.S. PATENT DOCUMENTS 6,641,438 B1 * 11/2003 Billman ..... 439/608
6,648,689 B1 * 11/2003 Billman et al. ..... 439/608

* cited by examiner

*Primary Examiner*—Tho D Ta
(74) *Attorney, Agent, or Firm*—Lily Neff; Stephen Bongini; Fleit, Gibbons, Gutman, Bongini & Bianco P.L.

(57) ABSTRACT

A large array connector is disclosed. The connector includes a plate comprising front, rear, top, bottom, first side, and second side portions. A plurality of guide blocks provide rigid support to at least the plate. A first guide block is mechanically coupled to a first end of the front portion. A second guide block is mechanically coupled to a second end of the front portion. A plurality of wafers is located between the first guide block and the second guide block. A front portion of each of the wafers is mateable with a mid-plane. A fill material is provided between a first portion of each of the wafers and the front portion of the plate. The fill material substantially mechanically couples the first portion of each of the wafers and the front portion of the plate, and provides rigid support to each of the wafers during plug-in with the mid-plane.

19 Claims, 4 Drawing Sheets

LARGE ARRAY CONNECTOR FOR COUPLING WAFERS WITH A PRINTED CIRCUIT BOARD

FIELD OF THE INVENTION

The present invention generally relates to the field of large array connectors, and more particularly relates to providing rigid support to conductive bonding joints within a large array connector.

BACKGROUND OF THE INVENTION

Large array connectors are generally used to make separable connections between two printed circuit boards. A large array connector can include hundreds of wafers that each have multiple leads that are soldered to the daughter card. Therefore, a large array connector can house thousands of leads that are soldered to a printed circuit board ("PCB"). A large array connector can be used to couple a functional side of the wafers into a mid-plane (e.g., motherboard) and leads of the wafers to a PCB such as a daughter card. This allows the daughter card and mid-plane to communicate with each other.

However, many SMT (Surface Mount Technology) large array connectors generally do not provide enough support to the wafers during plug-in of the wafers to the mid-plane. This lack of support results in stress at the solder joints between the wafer leads and PCB surface mount pads. In many instances the stress causes the solder joints to fail. Another problem with conventional large array connectors is that they generally do not provide enough support to the wafers for proper alignment with the surface mount pads on the PCB and with the mid-plane connector header. This stress causes the wafer leads to be improperly soldered onto the PCB and misaligned with the mid-plane connector header. Such mis-registration can cause the solder joints to have a higher stress because of the reduced solder joint cross area, creating an out of specification condition or fail when the wafers are plugged into the mid-plane.

SUMMARY OF THE INVENTION

A large array connector for coupling a plurality of wafers with a printed circuit board is disclosed. The large array connector includes a plate comprising a front portion, a rear portion, a top portion, a bottom portion, a first side portion, and a second side portion. A plurality of guide blocks including first and second guide blocks provide rigid support to at least the plate. The first guide block is mechanically coupled to a first end of the front portion of the plate. The second guide block is mechanically coupled to a second end of the front portion of the plate. A plurality of wafers is located between the first guide block and the second guide block. A front portion of each of the wafers is mateable with a mid-plane. A fill material is provided between a first portion of each of the wafers and the front portion of the plate. The fill material substantially mechanically couples the first portion of each of the wafers and the front portion of the plate, and provides rigid support to each of the wafers during plug-in with the mid-plane.

In another embodiment, an electronic assembly is disclosed. The electronic assembly includes a printed circuit board comprising a plurality of mounting locations. A large array connector for coupling a plurality of wafers with the printed circuit board is mechanically coupled to the printed circuit board. The large array connector comprises a plate comprising a front portion, a rear portion, a top portion, a bottom portion, a first side portion, and a second side portion. A plurality of guide blocks including first and second guide blocks provide rigid support to at least the plate. The first guide block is mechanically coupled to a first end of the front portion of the plate. The second guide block is mechanically coupled to a second end of the front portion of the plate. A plurality of wafers is located between the first guide block and the second guide block. A front portion of each of the wafers is mateable with a mid-plane. A fill material is provided between a first portion of each of the wafers and the front portion of the plate. The fill material substantially mechanically couples the first portion of each of the wafers and the front portion of the plate, and provides rigid support to each of the wafers during plug-in with the mid-plane.

In yet another embodiment, a large array connector for coupling a plurality of wafers with a printed circuit board is disclosed. The large array connector includes a plate comprising a front portion, a rear portion, a top portion, a bottom portion, a first side portion, and a second side portion. A plurality of guide blocks including a first guide block mechanically coupled to a first end of the front portion of the plate, a second guide block mechanically coupled at a second end of front portion of the plate, a third guide block, and a fourth guide block. The third and fourth guide blocks are mechanically coupled to the front portion of the plate at locations equidistant from the first end and second end, respectively. A plurality of wafers are located between the first and third guide blocks, the third and fourth guide blocks, and the fourth and second guide blocks. A front portion of each of the wafers is mateable with a mid-plane. A fill material is provided between a first portion of each of the wafers and the front portion of the plate. The fill material substantially mechanically couples the first portion of each of the wafers and the front portion of the plate, and provides rigid support to each of the wafers during plug-in with the mid-plane.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

Embodiments of the present invention incorporate a large array connector that provides rigid support to wafers so that stresses experienced during mid-plain plug-in are distributed throughout the connector. This prevents plug-in and shear forces experienced by the wafers from compromising the solder joints between the PCB and the wafer leads. One embodiment of the present invention provides a fill material between a back plate of the connector and the wafers to absorb and dissipate these forces experienced by the wafers.

Forces and Stresses Experienced by a Wafer in a Large Array Connector

Figure 1:
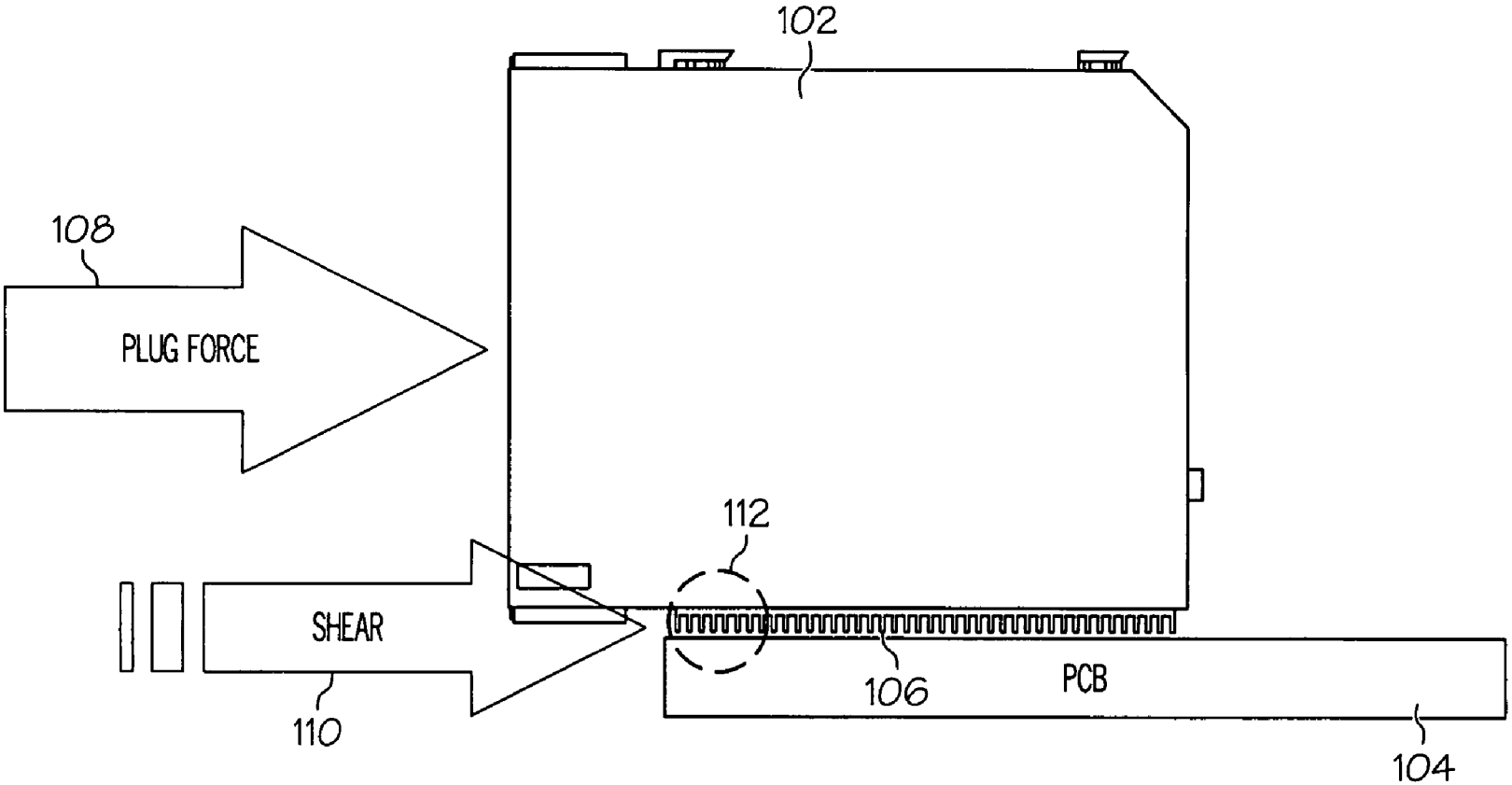
FIG. 1 shows a side perspective view of a wafer and a PCB according to one embodiment of the present invention.

FIG. 1 is a side perspective view of a wafer used within a large array connector and a PCB. In particular, FIG. 1 shows a wafer 102 and a PCB 104 that the wafer 102 mates to via leads 106 on the wafer 102 and surface mount pads on the PCB 104. FIG. 1 also shows the various forces 108 and 110 that the wafer 102 experiences. After the wafer 102 is surface mounted to the PCB 104, the wafer 102 is plugged into a mid-plane (such as mid-plane 338 of FIG. 3) resulting in a plug force 108 and a shear force 110. Conventional connectors do not provide enough support to the wafer 102 to effectively protect the solder joints between the PCB 104 and the leads 106 of the wafer 102 from the plug force 108 and the shear force 110. These forces 108 and 110 are mostly absorbed by the solder joints between the surface mounts pads on the PCB 104 and the leads 106 of the wafer 102, and create a high stress area 112 among the solder joints that can lead to breakage and failure.

Embodiments of the present invention overcome these problems by using a connector that provides rigid support to the wafers within the connector. The connector also provides proper alignment of the wafers with the surface mount pads on a PCB and with the mid-plane connector header.

Wafer

Figure 2:
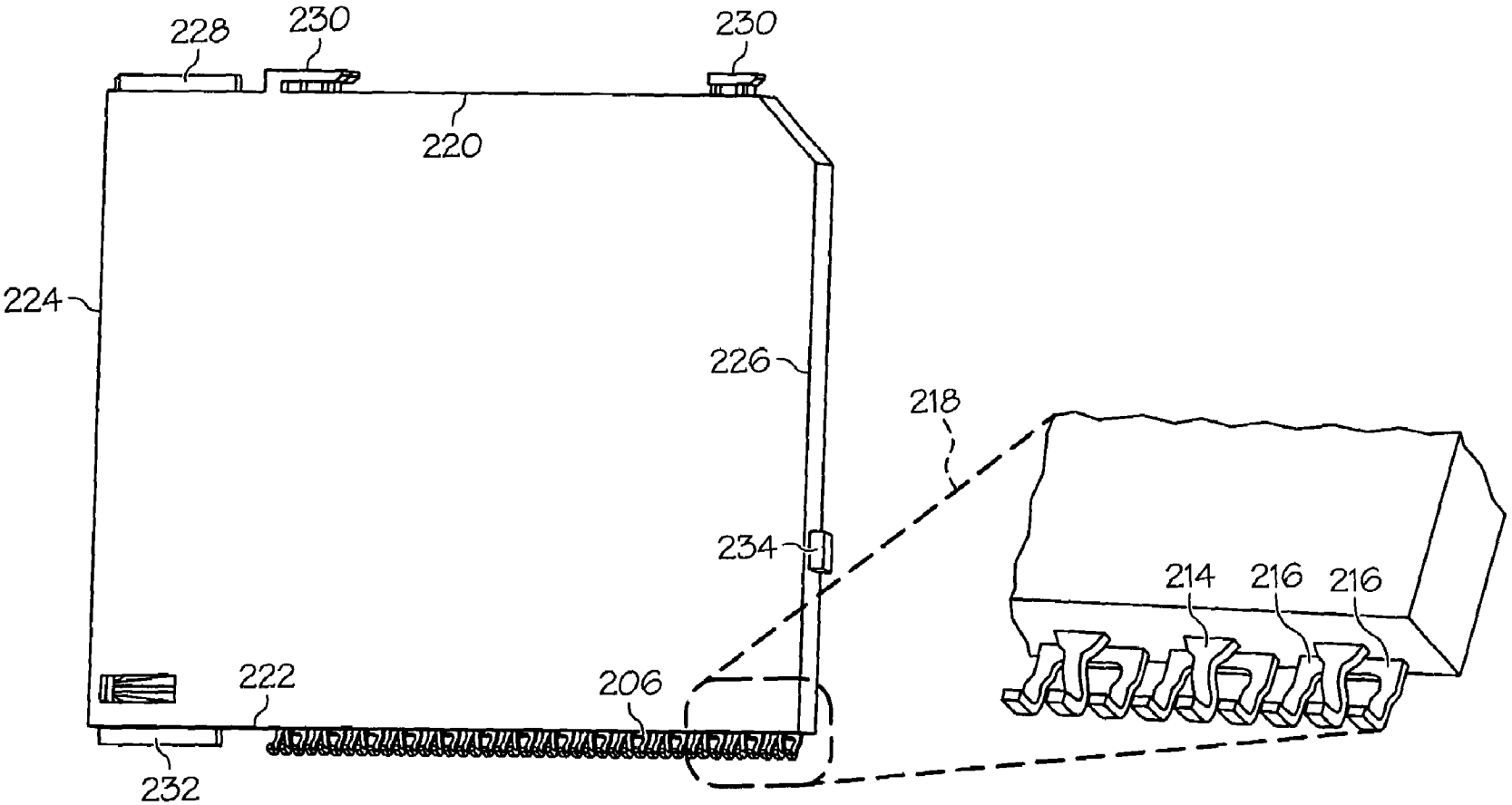
FIG. 2 shows a side perspective view and an exploded view of a wafer according to one embodiment of the present invention.

FIG. 2 is a side perspective view of a wafer 202 that is held by a connector according to one embodiment of the present invention. The wafer 202 of this embodiment has dimensions such as (but not limited to) 1.7 mm thick×43 mm high×35 mm wide. The wafer 202, in this exemplary embodiment, is molded from a synthetic material such as (but not limited to) plastic and has two planes of metallization such as (but not limited to) copper. The planes of metallization make up the signal plane and ground plane of the leads 206. The leads 206 include signal leads 214 and ground leads 216, as shown in the exploded view 218 of the leads 206. In this embodiment, each signal lead 214 has a ground lead 216 on each of its sides. The ground leads 216 isolate the signal lead 214 from noise and other interference. The leads 206, in this embodiment, are surface mounted onto surface pads of a PCB 304.

The wafer 202 has a top face 220, a bottom face 222, a front face 224, and a rear face 226. The top face 220 includes a top rib or tab 228 and optional appendages 230. The top rib 228 mates with a corresponding receptacle on the connector header on the mid-plane. The optional appendages 230 can have varying functions such as spacing the wafer 202 from a top plate of a cradle assembly used when shipping the wafers, and properly placing the wafers onto the PCB 304 and/or aligning the wafer for proper soldering to a PCB 304. The bottom face 222 includes the leads 206 and a bottom rib or tab 232. The bottom rib 232 also mates with a corresponding receptacle (e.g., groove and/or slot) on the connector header on the mid-plane.

The front face 224 of the wafer 202 is the functional end of the wafer 202 and is referred to as the "separable interface" or "pluggable end" of the wafer 202. This functional end mates with the mid-plane and allows a PCB such as a daughter card to communicate with the mid-plane. The rear face 226 includes a rear rib 234 that has varying functions such as spacing the wafer 202 by a plate of the cradle assembly used when shipping the wafers and properly placing the wafers onto the PCB 304 and aligning the wafers for proper soldering to a PCB 304.

Large Array Connector

Figure 3:
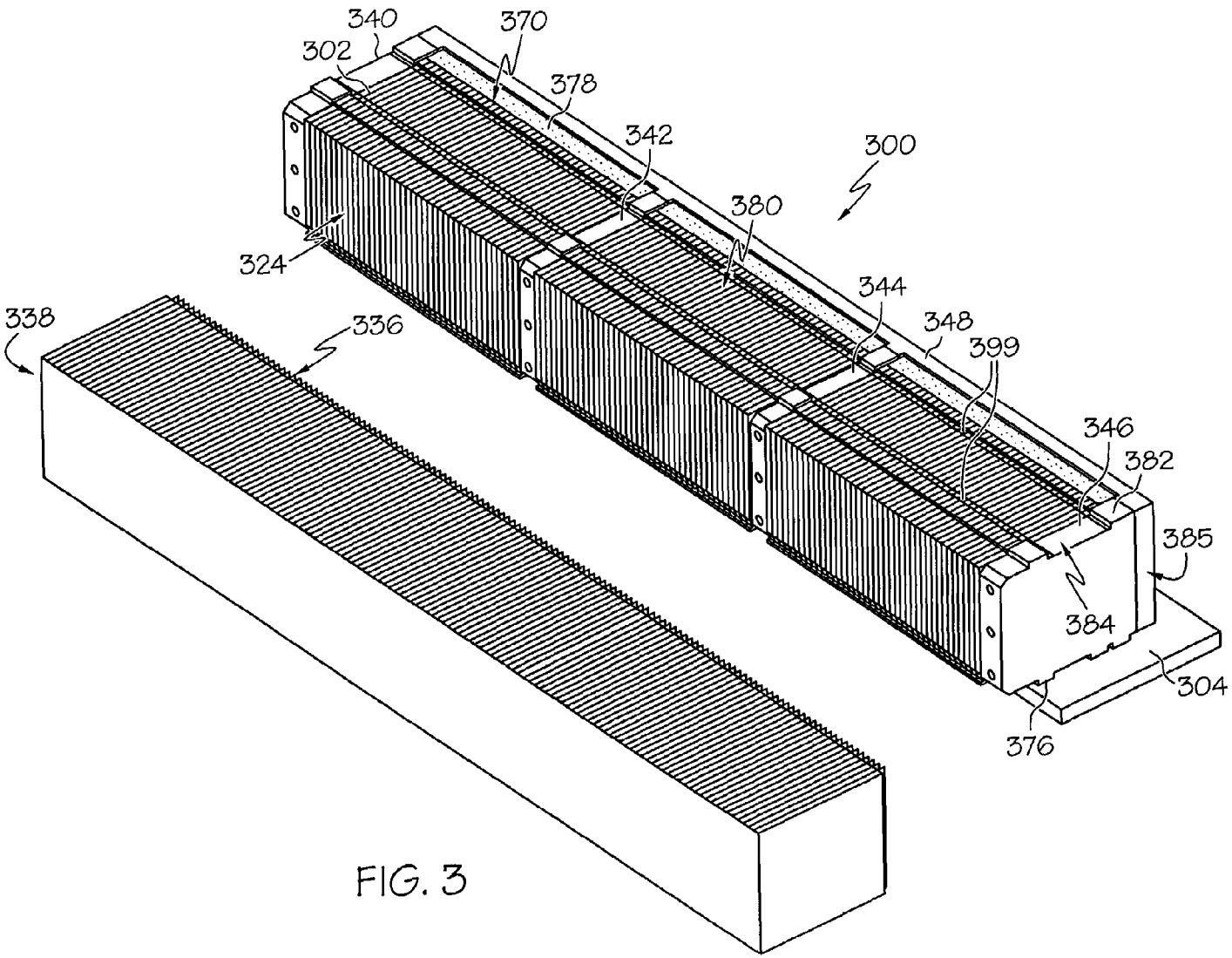
FIG. 3 shows a front perspective view from above of a large array connector and a top perspective view of a mid-plane in accordance with one embodiment of the present invention.

FIG. 3 shows a large array connector 300 according to one embodiment of the present invention. In particular, FIG. 3 shows a large array connector 300 comprising multiple wafers 302. In this embodiment, the connector 300 holds 120 wafers 302; however, any number of wafers 302 can be held by the connector 300. FIG. 3 also shows the connector 300 mechanically coupled to a PCB 304 such as (but not limited to) a daughter card. In this embodiment, the "array" is the entire set of leads 206 of the wafers 302 within the connector 300. If the connector 300 holds 120 wafers 302 and each has 14 signal leads 214 and 28 ground leads 216 (for a total of 42 leads), the entire array then comprises 42×120=5,040 leads.

As discussed above, the functional ends 324 (i.e., the front face 324) of the wafers 302 mate with corresponding receptacles 336 on the mid-plane 338 (e.g., motherboard). In this embodiment, the connector 300 is part of a cradle assembly that maintains the wafers 302 during shipment from the wafer manufacturer to the wafer customer. The cradle assembly protects the wafers 302 and wafer leads 206 during shipment and also places the wafers 302 in proper alignment for surface mounting the leads 206 of the wafers to surface pads on the PCB 304. Stated differently, the cradle assembly provides a high degree of positional accuracy and co-planarity of the wafers 302. Once the wafers 302 have been coupled to the PCB 304 by (for example, through a surface mounting technology process), various components of the cradle assembly are removed. The cradle assembly is discussed in greater detail in co-pending U.S. patent application entitled "Large Array Surface Mount Technology Connector Cradle Assembly", Ser. No. 12/036,933, which was filed on the same day as the present application and commonly assigned herewith to International Business Machines Corporation (of Armonk, N.Y.). This related application is incorporated herein by reference in its entirety.

The connector 300 of this embodiment has one or more guide blocks 340, 342, 344, and 346, which are collectively referred to as "guide block 342" or "guide blocks 342". The guide blocks 342 provide structural support to the wafers 302 and to the back plate 348 of the connector 300, and also provide rigidity to the connector 300 itself. The guide blocks 342 provide support in the X-Y direction to the wafers 302 and in some embodiments are also mechanically coupled to the back plate 348 to provide a more rigid structure for the connector 300. The guide blocks 342 also provide rough alignment for mating the functional end 324 of each wafer 302 with the corresponding receptacle 336 of the mid-plane 338. The guide blocks 342 of this embodiment also act as a hard stop when the functional ends 324 of the wafers 302 are seated within the mid-plane 338. In this embodiment, the guide blocks are recessed so that the functional ends 324 of the wafers 302 extend beyond the guide blocks 342. In another embodiment, the guide blocks 342 are flush with the functional ends 324 of the wafers 302.

Figure 4:
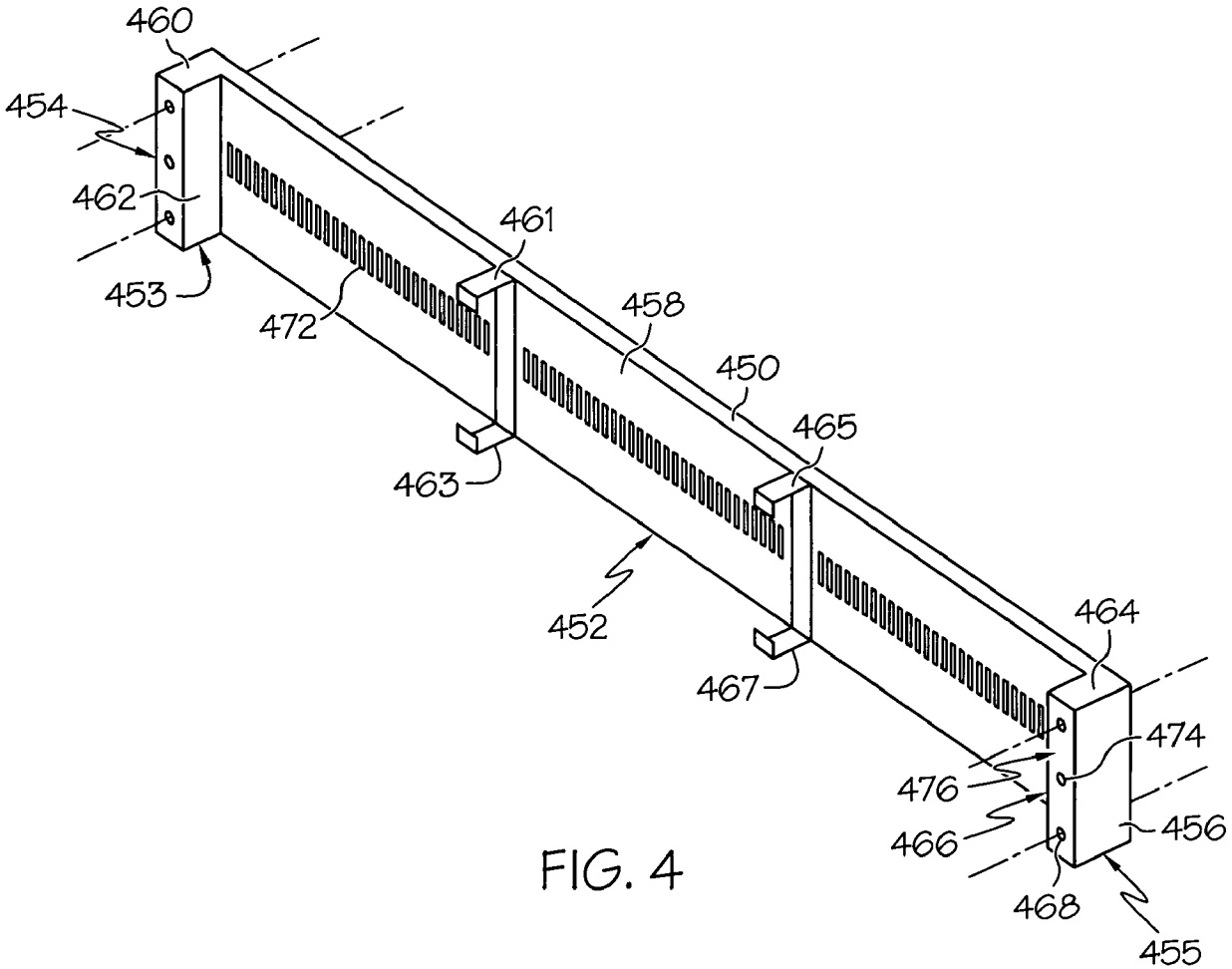
FIG. 4 shows a front perspective view from above of a back plate of the large array connector of FIG. 3 according to one embodiment of the present invention.

The back plate 348 can be seen in more detail in FIG. 4, which shows a front perspective view of the back plate 348. In this embodiment, the back plate 348 includes a top portion 450, a bottom portion 452, a first side portion 454, a second side portion 456, a front portion 458, and a back portion. The back plate 348 also includes a first extending member 460 that extends in an outward fashion from the top portion 450 and first side portion 454 with respect to the front portion 458. The back plate 348 also includes a second extending member 462 that extends in an outward fashion from the bottom portion 452 and first side portion 454 with respect to the front portion 458.

The back plate 348 also includes a third extending member 464 that extends in an outward fashion from the top portion 450 and second side portion 456 with respect to the front portion 458. The back plate 348 also includes a fourth extending member 466 that extends in an outward fashion from the bottom portion 452 and second side portion 456 with respect to the front portion 458. The first, second, third, and fourth extending members 460, 462, 464, and 466 create a space or gap 370 (FIG. 3) between the back plate 348 and the rear face 226 of the wafers 302.

The back plate 348 can also include additional extending members 461, 463, 465, and 467 depending on how many guide blocks 342 are used within the connector 300. More generally, the back plate 348 is not limited to including the extending members 460, 462, 464, and 466 of the illustrated embodiment. For example, the back plate 348 can be manufactured without the extending members 460, 462, 464, and 466 so that the front portion 458 of the back plate 348 rests flush against a rear portion 385 of the guide blocks 342. In such an embodiment, the guide blocks 342 extend beyond the rear face 226 of the surface to create the space or gap 370 between the guide block 342 and the back plate 348.

The back plate 348 of the illustrated embodiment includes slots or grooves 472 that receive the rear rib 234 of each wafer 302. The slots/grooves 472 provide support to the wafers 302 so that movement in the X-Y direction is limited or prevented. The slots/grooves 472 can also be configured to allow movement in the Z direction (i.e., up and down) so that the wafers 302 can float within the cradle assembly during the surface mounting process.

The back plate 348 can also include fastening areas 468 and 474 at one or more of the extending members 460, 462, 464, and 466 that pass through the back portion of the back plate 348 to a front portion 476 of the extending member 460, 462, 464, and 466. The fastening areas 468 allow various types of fasteners to mechanically couple the back plate 348 to the guide blocks. In addition to or instead of fasteners, a dowel or pin can be inserted into the one or more fastening areas 468 and 474 for coupling the back plate 348 to the guide blocks 342. In another embodiment, the back plate can be welded by any type of welding process, or adhered to the guide blocks 342 with an adhesive material. The bottom portion 452 of the back plate 348, a bottom portion 453 of the second extending member 462, and/or a bottom portion 455 of the fourth extending member 466 can also include fastening areas for fastening the back plate to the PCB 304. In yet another embodiment, the back plate 348 and the guide blocks 342 (at least the two outer guide blocks 340 and 346) are a single integral piece.

Returning now to FIG. 3, the guide blocks 342 are mechanically coupled to the PCB 304 by, for example, one or more fasteners that are coupled to corresponding fastening areas on the PCB 304. For example, in this embodiment each guide block 342 includes one or more fastening areas 376 that align with corresponding fastening areas on the PCB 304. By fastening the guide blocks 342 and/or the back plate 348 to the PCB 304, the connector 300 becomes more rigid, provides mechanical support to each wafer 302, and helps maintain positional accuracy when plugging the wafers 302 into the mid-plane 338.

Conventional connectors either do not include a back plate or have a back plate that does not provide any rigid support to the wafers. For example, in a typical conventional connector a gap exists between the wafers and the back plate, as explained above. The tolerances placed on the wafers are usually not tight enough so that the wafers make consistent contact with the back plate. Without the proper support, the leads at the corner closest to the rear face 226 of the wafer become a pivot point when plugging the wafers into the mid-plane. The wafer becomes torqued and twisted due to the plug and shear forces experienced at the leads and solder joints. These stresses eventually cause the solder joints to fail.

Therefore, the connector 300 of this embodiment of the present invention includes a fill material 378 (shown by cross-hatching) between the back plate 348 and the wafers 302. The fill material 378 fills the space/gap 370 between the back plate 348 and the wafers 302 and contacts both the wafers 302 and the front portion 458 of the back plate 348. The fill material 378 can be poured directly into the space/gap 370 and a vacuum can be used to remove air bubbles if needed. Alternatively, the use of a top plate could be used in place of the backplate. In this case, the gap 380 between the top surface of the wafers and the top plate could be filled with the fill material. In addition, gaps 399 between any appendages and the top plate could be filled.

In this embodiment, the fill material 378 does not adhere to the wafers 302 so that the wafers 302 can be removed from the connector 300. If the fill material is a material with adhering properties, the areas of the wafers 302 that contact the fill material 378 can be coated with a releasing agent such as petroleum. In an alternative embodiment, the fill material 378 adheres to the wafer 302 and/or the back plate. The following are a few examples of fill material that can be used to attach the wafers to the plate: thermoset or thermoplastic, one or two component, room or elevated-temperature cure, structural adhesives such as epoxies, polyurethanes, modified acylics, cyanoacrylates, silicones and phenolics.

The fill material 378 makes the connector 300 more rigid and takes the stress off of the solder joints existing between the leads 206 of the wafers 302 and the surface mount pads of the PCB 304 when plugging the wafers 302 into the mid-plane 338. In particular, when the wafers 302 are mated with the mid-plane, plug forces and shear forces that normally stress the solder joints between the leads 206 and surface pads are relieved by the fill material 378. This is because as force is applied to the functional end 324 of the wafer during plug-in, the fill material 378 keeps the wafers from pivoting and/or torquing. The fill material 378 contacting the rear face 226 of the wafer 302 and the back plate thus reduces the stress at the solder joints.

In another embodiment, the connector 300 includes a top plate, which is similar to the back plate 348. The top plate is mechanically coupled to the top portion 380 of the connector 300, and can be in addition to or in replacement of the back plate 348. This top plate can be mechanically coupled to the guide blocks at one or more fastening areas 382 on a top portion 384 of the guide blocks (as discussed above with respect to the back plate). These fastening areas 382, in one embodiment, extend in an upward fashion away from the top portion 384 of the guide block 342, so as to create a space/gap similar to the space/gap 370 between the wafers 302 and the back plate 348 in the embodiment described above. The fill material 378 can then be placed in the space/gap for providing rigid support to the wafers 302 during plug-in with the mid-plane 338.

The guide blocks 342 are not limited to having fastening areas 382 that extend upwards away from the top portion of the guide block 348. The fastening areas 382 can be flush with the top portion 384 and the top plate can include extending members as described above with respect to the back plate 348. If both a top plate and a back plate 348 are provided, the connector 300 becomes even more rigid and provides even more support to the wafers 302.

Accordingly, embodiments of the present invention provide rigid support to wafers within a large array connector so that stresses experienced at solder joints during mid-plane plug-in are prevented or reduced. A fill material can be placed between the wafers and the back plate and/or top plate so that the wafers have mechanical support during the plug-in process. This mechanical support allows the stresses usually experienced at the solder joints to be dissipated through the connector, so as to reduce or eliminate solder breakage and failure.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

Embodiments of the present invention can be implemented in hardware or software, or in a combination of hardware and software. For example, one embodiment of the present invention is implemented in hardware such as that used for assembling electronic assembly mounting areas such as (but not limited to) PCB boards. In another embodiment, the present invention is implemented in software such as that used for controlling and performing the assembly of electronic assembly mounting areas, such as PCB boards.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library, and/or other sequence of instructions designed for execution on a computer system.

What is claimed is:

1. A large array connector for coupling a plurality of wafers with a printed circuit board, the large array connector comprising:

a plate comprising a front portion, a rear portion, a top portion, a bottom portion, a first side portion, and a second side portion;

a plurality of guide blocks including first and second guide blocks for providing rigid support to at least the plate, the first guide block being mechanically coupled to a first end of the front portion of the plate, and the second guide block being mechanically coupled to a second end of the front portion of the plate; and a plurality of wafers located between the first guide block and the second guide block, a front portion of each of the wafers being mateable with a mid-plane, wherein a fill material is provided between a first portion of each of the wafers and the front portion of the plate, the fill material substantially mechanically coupling the first portion of each of the wafers and the front portion of the plate, and providing rigid support to each of the wafers during plug-in with the mid-plane, and each of the guide blocks comprise fastening areas located on a bottom portion thereof, the fastening areas corresponding to fastening areas on a printed circuit board for mechanically coupling the guide block to the printed circuit board.

2. The large array connector of claim 1, wherein the rear portion of the plate comprises a plurality of fastening areas that extend through the rear portion to the front portion of the plate, and each of the fastening areas corresponds to a corresponding fastening area located on a rear portion of the first guide block or the second guide block for mechanically coupling the plate to the first guide block or the second guide block.

3. The large array connector of claim 1, wherein the fill material is located between a rear portion of each of the wafers and the front portion of the plate.

4. The large array connector of claim 1, wherein the plate is situated above a top portion of each of the wafers, and the fill material is situated between the top portion of each of the wafers and the front portion of the plate.

5. The large array connector of claim 1, wherein the front portion of the plate comprises a plurality of slots each for receiving a tab situated on the first portion of each of the wafers.

6. The large array connector of claim 1, further comprising an additional plate mechanically coupled to a second portion of the first guide block and a second portion of the second guide block, a front portion of the additional plate facing a second portion of each of the wafers.

7. The large array connector of claim 6, wherein the fill material is also located between the second portion of each of the wafers and the front portion of the additional plate, the fill material substantially mechanically coupling the second portion of each of the wafers and the front portion of the additional plate.

8. An electronic assembly comprising:

a printed circuit board comprising a plurality of mounting locations; and a large array connector for coupling a plurality of wafers with the printed circuit board, the large array connector being mechanically coupled to the printed circuit board, and wherein the large array connector comprises:

a plate comprising a front portion, a rear portion, a top portion, a bottom portion, a first side portion, and a second side portion;

a plurality of guide blocks including first and second guide blocks for providing rigid support to at least the plate, the first guide block being mechanically coupled to a first end of the front portion of the plate, and the second guide block being mechanically coupled to a second end of the front portion of the plate; and a plurality of wafers located between the first guide block and the second guide block, a front portion of each of the wafers being mateable with a mid-plane, wherein a fill material is provided between a first portion of each of the wafers and the front portion of the plate, the fill material is substantially continuous between each wafer, and the fill material substantially mechanically couples the first portion of each of the wafers and the front portion of the plate, and provides rigid support to each of the wafers during plug-in with the mid-plane.

9. The electronic assembly of claim 8, wherein the rear portion of the plate comprises a plurality of fastening areas that extend through the rear portion to the front portion of the plate, and each of the fastening areas corresponds to a corresponding fastening area located on a rear portion of the first guide block or the second guide block for mechanically coupling the plate to the first guide block or the second guide block.

10. The electronic assembly of claim 8, wherein each of the guide blocks comprise fastening areas located on a bottom portion thereof, the fastening areas corresponding to fastening areas on a printed circuit board for mechanically coupling the guide block to the printed circuit board.

11. The electronic assembly of claim 8, wherein the fill material is located between a rear portion of each of the wafers and the front portion of the plate.

12. The electronic assembly of claim 8, wherein the plate is situated above a top portion of each of the wafers, and the fill material is situated between the top portion of each of the wafers and the front portion of the plate.

13. The electronic assembly of claim 8, further comprising an additional plate mechanically coupled to a second portion of the first guide block and a second portion of the second guide block, a front portion of the additional plate facing a second portion of each of the wafers.

14. The electronic assembly of claim 8, wherein the fill material is also located between the second portion of each of the wafers and the front portion of the additional plate, the fill material substantially mechanically coupling the second portion of each of the wafers and the front portion of the additional plate.

15. The electronic assembly of claim 8, wherein the front portion of the plate comprises a plurality of slots each for receiving a tab situated on the first portion of each of the wafers.

16. A large array connector for coupling a plurality of wafers with a printed circuit board, the large array connector comprising:

a plate comprising a front portion, a rear portion, a top portion, a bottom portion, a first side portion, and a second side portion;

a plurality of guide blocks including a first guide block mechanically coupled to a first end of the front portion of the plate, a second guide block mechanically coupled at a second end of front portion of the plate, a third guide block, and a fourth guide block, wherein the third and fourth guide blocks are mechanically coupled to the front portion of the plate at locations equidistant from the first end and second end, respectively, and a plurality of wafers located between the first and third guide blocks, the third and fourth guide blocks, and the fourth and second guide blocks, a front portion of each of the wafers being mateable with a mid-plane, wherein a fill material is provided between a first portion of each of the wafers and the front portion of the plate, the fill material substantially mechanically coupling the first portion of each of the wafers and the front portion of the plate, and providing rigid support to each of the wafers during plug-in with the mid-plane.

17. The large array connector of claim 16, wherein the rear portion of the plate comprises a first, second, third, and fourth fastening area that extend through the rear portion to the front portion of the plate, and each of the first, second, third, and fourth fastening area corresponds to a corresponding fastening area located on a rear portion of the first, second, third, and fourth guide blocks, respectively, for mechanically coupling the plate to the first, second, third, and fourth guide blocks.

18. The large array connector of claim 16, wherein each of the first, second, third, and fourth guide blocks comprise at least two fastening areas located on a bottom portion thereof, the fastening areas corresponding to fastening areas on a printed circuit board for mechanically coupling the first, second, third, and fourth guide blocks to the printed circuit board.

19. The large array connector of claim 16, wherein the fill material is located between a rear portion of each of the wafers and the front portion of the plate.

* * * * *